US009645535B2

(12) United States Patent
Yamaoka et al.

(10) Patent No.: US 9,645,535 B2
(45) Date of Patent: May 9, 2017

(54) FIXING DEVICE FOR FIXING A TONER IMAGE ON A SHEET-SHAPED RECORDING MEDIUM AND IMAGE FORMATION APPARATUS

(71) Applicants: Hironori Yamaoka, Kanagawa (JP); Shinichi Namekata, Kanagawa (JP); Tsukasa Satoh, Kanagawa (JP)

(72) Inventors: Hironori Yamaoka, Kanagawa (JP); Shinichi Namekata, Kanagawa (JP); Tsukasa Satoh, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/311,473

(22) Filed: Jun. 23, 2014

(65) Prior Publication Data

US 2014/0376938 A1 Dec. 25, 2014

(30) Foreign Application Priority Data

Jun. 25, 2013 (JP) ..... 2013-132921

(51) Int. Cl.
*G03G 15/20* (2006.01)

(52) U.S. Cl.
CPC ..... *G03G 15/2042* (2013.01)

(58) Field of Classification Search
CPC ..... G03G 15/20; G03G 15/2042; G03G 15/2082; G03G 15/2021; G03G 15/2017;
(Continued)

(56) References Cited

U.S. PATENT DOCUMENTS 4,585,325 A * 4/1986 Euler ..... G03G 15/2042 219/216
5,241,159 A * 8/1993 Chatteriee ..... G03G 15/2053 219/216

(Continued)

FOREIGN PATENT DOCUMENTS

JP 57-053773 3/1982
JP 63-044223 2/1988

(Continued)

OTHER PUBLICATIONS

U.S. Appl. No. 14/206,301, filed Mar. 12, 2014.
Office Action for Corresponding Japanese Patent Application No. 2013-132921 issued on Jan. 31, 2017.

*Primary Examiner* — Clayton E LaBalle
*Assistant Examiner* — Victor Verbitsky
(74) *Attorney, Agent, or Firm* — Harness, Dickey & Pierce, P.L.C.

(57) ABSTRACT

A fixing device includes a rotational member configured to convey and heat a sheet-shaped recording medium, the rotational member including a first heating member and a second heating member provided in parallel to a rotational axis of the rotational member in an interior thereof, the first heating member including a first heat generation part, the second heating member including a second heat generation part and an auxiliary heat generation part adjacent to the second heat generation part, a common temperature sensor configured to sense a temperature of the first heating member and a temperature of the second heating member, and a control part configured to control a ratio of a rate of lighting of the first heating member and a rate of lighting of the second heating member based on the temperature of the first heating member and the temperature of the second heating member.

8 Claims, 3 Drawing Sheets

(58) Field of Classification Search
CPC ..... G03G 15/2014; G03G 2215/20; G03G 2215/2006; G03G 2215/2045
See application file for complete search history.

(56) References Cited

U.S. PATENT DOCUMENTS

| | | | | |
|---|---|---|---|---|
| 5,819,134 | A | 10/1998 | Sato et al. | |
| 6,810,220 | B2 * | 10/2004 | Hamada | G03G 15/205 219/216 |
| 7,248,807 | B2 | 7/2007 | Oka et al. | |
| 2008/0025746 | A1 * | 1/2008 | Kanai | G03G 15/2064 399/69 |
| 2010/0028037 | A1 * | 2/2010 | Song | G03G 15/2039 399/70 |
| 2010/0239301 | A1 * | 9/2010 | Nemoto | G03G 15/2039 399/69 |

FOREIGN PATENT DOCUMENTS

| | | | |
|---|---|---|---|
| JP | 64-011285 | | 1/1989 |
| JP | 08-016030 | | 1/1996 |
| JP | 09-114313 | | 5/1997 |
| JP | 2000-259034 | A | 9/2000 |
| JP | 2001-202926 | | 7/2001 |
| JP | 2003-151722 | | 5/2003 |
| JP | 2003-272802 | | 9/2003 |
| JP | 2003-302862 | | 10/2003 |
| JP | 2004-212550 | | 7/2004 |
| JP | 2004-325742 | | 11/2004 |
| JP | 3599087 | | 12/2004 |
| JP | 2005-077454 | A | 3/2005 |
| JP | 2005-156843 | | 6/2005 |
| JP | 2005-156977 | | 6/2005 |
| JP | 2005-227420 | | 8/2005 |
| JP | 2005-234426 | | 9/2005 |
| JP | 2005-301041 | | 10/2005 |
| JP | 3741684 | | 2/2006 |
| JP | 2007-316169 | A | 12/2007 |
| JP | 4687043 | | 5/2011 |
| JP | 2013-088498 | | 5/2013 |
| JP | 2013-113964 | A | 6/2013 |
| JP | 2013-174806 | | 9/2013 |

* cited by examiner

FIXING DEVICE FOR FIXING A TONER IMAGE ON A SHEET-SHAPED RECORDING MEDIUM AND IMAGE FORMATION APPARATUS

BACKGROUND OF THE INVENTION

1. Field of the Invention

An aspect of the present invention relates to at least one of a fixing device for fixing a toner image on a sheet-shaped recording medium and an image formation apparatus.

2. Description of the Related Art

In an image formation apparatus for forming an image on a recording paper sheet (paper sheet) that is a sheet-shaped recording medium by means of an electro-photographic method as a copying machine, a facsimile machine, or a printer, a photoconductor body is electrically charged by an electrical charging device and subsequently an electrostatic latent image is formed on a surface of the photoconductor body by optical writing in accordance with an original image or image information, or the like. This electrostatic latent image becomes a toner image that is a visible image, due to a developing device. The recording paper sheet is heated and pressurized by a fixing device so that this toner image is fixed on the recording paper sheet to obtain a copy or a print.

For a fixing device used in an image formation apparatus, two methods are used currently. One is a roller method wherein a heating roller with a heat generation part in an interior thereof and a pressurizing roller that rotates while contacting the heating roller are provided and a recording paper sheet is conveyed to a gap between the heating roller and the pressurizing roller to heat and pressurize the recording paper sheet and thereby fix a toner image thereon. The other is a belt method wherein an endless-type fixing belt extends on a heating roller with a heat generation part and a heating roller and a recording paper sheet is conveyed to a gap between this fixing belt and a pressurizing roller to be heated and pressurized and thereby fix a toner image thereon. Furthermore, a heat source may be placed directly on an inside of the fixing belt.

High productivity or energy saving is desired for an image formation apparatus. Furthermore, an applicability for dealing with recording paper sheets with various thicknesses or sizes is also desired. In particular, in a case where recording paper sheets that are composed of cardboard are continuously conveyed while high productivity is kept, thermal energy stored in a fixing device is removed sequentially. Hence, it is necessary to energize a heat generation source for heating and thereby replenish lost heat in order to ensure a fixation property.

In a fixing device that uses an infrared ray heater as such a heat generation source, it is desired that a rate of lighting of the infrared ray heater is increased to heat a heating roller quickly. Furthermore, in a case of a sheathed heater, it is necessary to increase a rate of energizing thereof. Herein, a rate of lighting or a rate of energizing refers to a rate of an amount of a supplied electric power for providing a practical amount of heat generation to an amount of a supplied electric power corresponding to a maximum capability of heat generation.

In Japanese Examined Patent Application Publication No. 63-044223, a problem in a case where a width of a conveyed paper sheet is small is that wasteful thermal energy is caused, and two heaters in which a lighting heater length necessary for a maximum size of a paper sheet to be conveyed is divided into two are shifted and arranged so that the heaters heat an entirety of a fixing roller uniformly. Thus, energizing is conducted in such a manner that two heaters are energized in a case of a recording medium with a large paper sheet width to be conveyed and only a heater at a side of a paper sheet to be conveyed is energized in a case of a recording medium with a small paper sheet width to be conveyed, so that it is possible to conduct fixation with no wasteful energy and a uniform temperature distribution.

Recently, it is desired that a printing operation is conducted at a higher speed. Accordingly, an amount of heat removed from a fixing roller by a paper sheet is increased so that a larger temperature difference is readily caused between a conveyance part and a non-conveyance part for a paper sheet. This is particularly significant in a fixing device in which a thickness of a fixing roller is decreased to improve a rate of temperature elevation and a heat capacity of the fixing roller is decreased. It is necessary to light a heater at a higher rate of lighting in order to replenish heat removed by a paper sheet. Accordingly, there is a problem that excessive thermal energy is provided at a non-conveyance part for a paper sheet to elevate temperature, and in a worst case, to exceed a heat-resistant temperature of a fixing roller (or belt) and a possibility of causing a serious issue such as deformation of a member is provided.

Furthermore, a low cost while attaining high functionality such as high productivity or energy saving as described above is also an important element. A method for prolonging a replacement cycle of a replacement component to reduce a cost of such a component or a cost of replacement by a serviceman or a method for reducing the number of components is considered as means for attaining cost reduction. However, any of the methods has a possibility of causing a problem in durability or a problem of functional degradation.

An object of an embodiment according to the present invention may be to solve such a problem.

SUMMARY OF THE INVENTION

According to one aspect of the present invention, there is provided a fixing device for fixing a toner image on a sheet-shaped recording medium, including a rotational member configured to convey and heat a sheet-shaped recording medium, the rotational member including a first heating member and a second heating member provided in parallel to a rotational axis of the rotational member in an interior thereof, the first heating member including a first heat generation part, the second heating member including a second heat generation part and an auxiliary heat generation part adjacent to the second heat generation part, the first heat generation part and the second heat generation part being provided not to overlap in a direction orthogonal to a direction of conveyance of the sheet-shaped recording medium, the auxiliary heat generation part being provided to overlap with the first heat generation part in a direction orthogonal to a direction of conveyance of the sheet-shaped recording medium, a common temperature sensor configured to sense a temperature of the first heating member and a temperature of the second heating member, and a control part configured to control a ratio of a rate of lighting of the first heating member and a rate of lighting of the second heating member based on the temperature of the first heating member and the temperature of the second heating member in a case where the first heating member and the second heating member are lighted.

According to another aspect of the present invention, there is provided an image formation apparatus, including the fixing device as described above.

DETAILED DESCRIPTION OF THE PREFERRED EMBODIMENTS

First Embodiment

Figure 1:
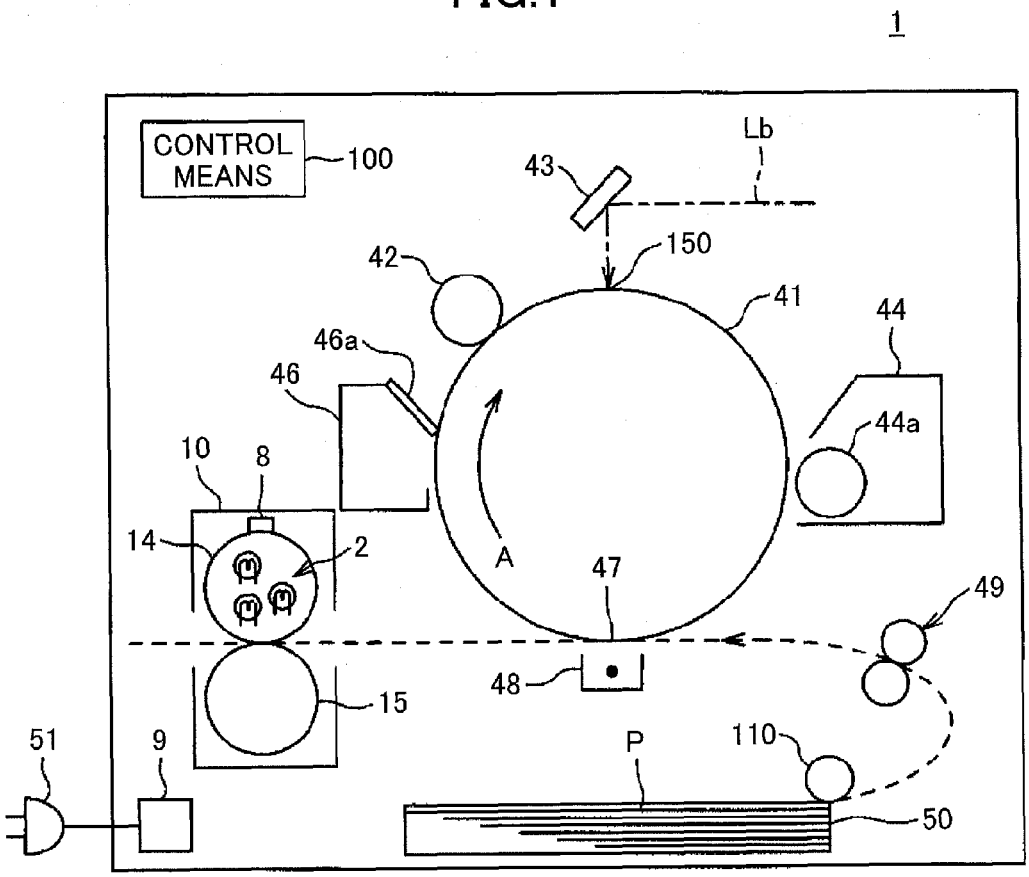
FIG. 1 is a schematic diagram that illustrates an internal structure of an image formation apparatus according to a first embodiment of the present invention.
Figure 2:
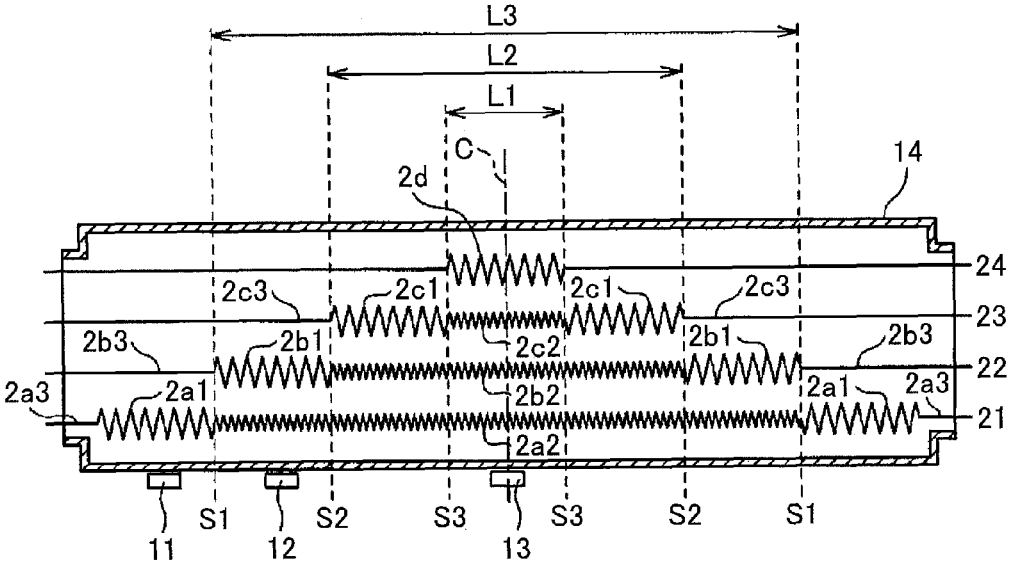
FIG. 2 is a schematic and cross-sectional diagram that illustrates positions of heat generation parts in a fixing device illustrates in FIG. 1.
Figure 3:
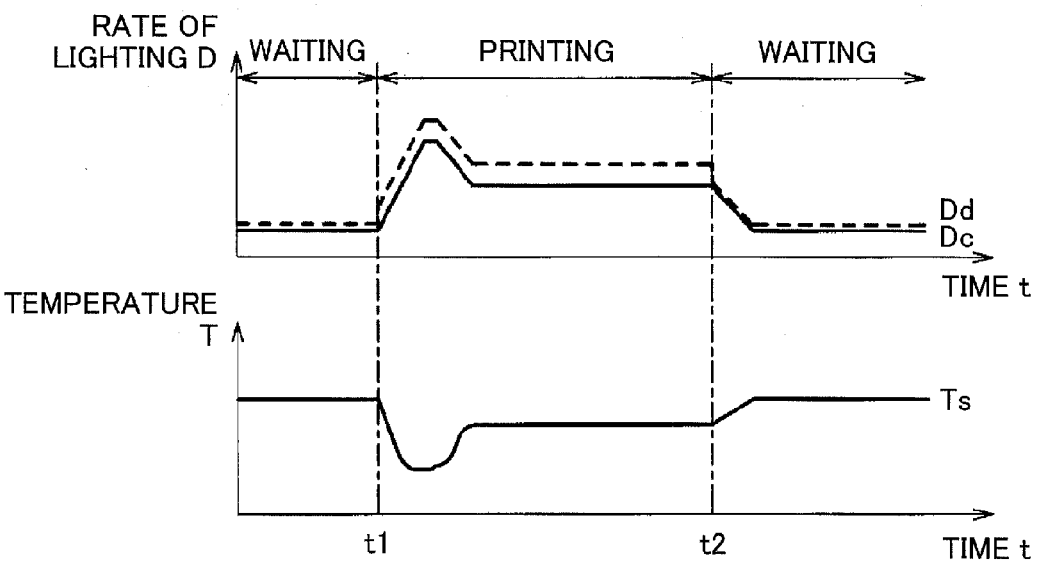
FIG. 3 is a timing chart that illustrates a control of heating members and a surface temperature of a heating roller in a fixing device illustrated in FIG. 1.
Figure 4:
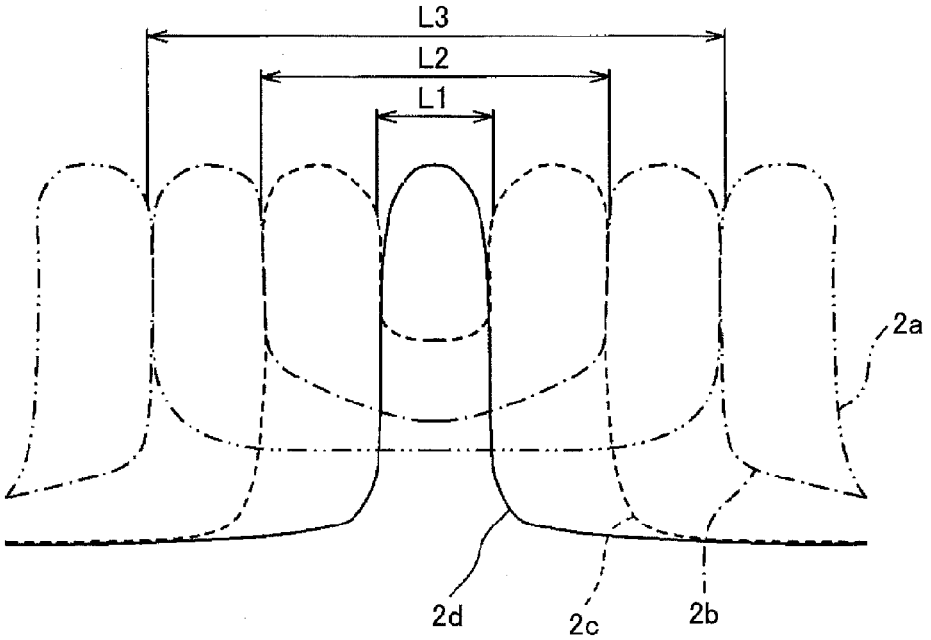
FIG. 4 is a graph of heat distributions of respective heating members in a configuration illustrated in FIG. 2.

A first embodiment of the present invention will be described with reference to FIG. 1 to FIG. 4 below. FIG. 1 is a schematic diagram that illustrates an internal structure of an image formation apparatus according to a first embodiment of the present invention. FIG. 2 is a schematic and cross-sectional diagram that illustrates positions of heat generation parts in a fixing device illustrated in FIG. 1. FIG. 3 is a timing chart that illustrates a control of heating members and a surface temperature of a heating roller in a fixing device illustrated in FIG. 1. FIG. 4 is a graph of heat distributions of respective heating members in a configuration illustrated in FIG. 2.

An image formation apparatus 1 according to a first embodiment of the present invention is, for example, a copying machine, a facsimile machine, or a printer, and records an image on a paper sheet P as a sheet-shaped recording medium by means of an electro-photographic method. The image formation apparatus 1 conducts printing on sheet-shaped recording media with various thicknesses or sizes such as a plain paper sheet to be generally used for a copy or the like, an OHP sheet, or a cardboard such as a post card.

The image formation apparatus 1 is provided with a drum-shaped photoconductor body 41, and around this photoconductor body 41, an electrical charger 42, a light exposure mirror 43 of a light exposure device, a developing device 44, a transfer device 48, and a cleaning device 46 are arranged along a direction A of rotation thereof. Furthermore, a paper feeding tray 50 for containing a paper sheet(s) P is arranged at a bottom of the apparatus. Here, an upstream in a case where a position of installation of the electrical charger 42 with respect to the photoconductor body 41 is a position of starting of rotation of the photoconductor body 41, and a downstream in a case where a position of installation of the cleaning device 46 is a position of ending of rotation of the photoconductor body 41 will be described below.

The electrical charger 42 is composed of an electrically charging roller that contacts a surface of the photoconductor body 41 and electrically charges a surface of the photoconductor body 41 uniformly. The light exposure device is provided at a downstream side of the electrical charger 42. The light exposure mirror 43 is supplied with a laser beam Lb that has image-processed an image read by an image reading device and reflects the supplied laser beam Lb onto a surface of the photoconductor body 41 to form an electrostatic latent image on a surface of the photoconductor body 41.

The developing device 44 supplies a toner onto a surface of the photoconductor body 41 to visualize an electrostatic latent image as a toner image and is provided with a developing roller 44*a* for supplying a toner onto a surface of the photoconductor body 41. For the transfer device 48, for example, a corona discharger is used that transfers a toner image visualized on a surface of the photoconductor body 41 onto a paper sheet P due to corona discharging.

The fixing device 10 conducts pressurizing and heating of a paper sheet P to fix an unfixed toner image. The cleaning device 46 is provided at a downstream side of the transfer device 48 and removes a toner remaining on a surface of the photoconductor body 41 after transfer of a toner image. In order to conduct such removal, the cleaning device 46 has a cleaning blade 46*a* that contacts a surface of the photoconductor body 41.

Paper sheets P as sheet-shaped recording media are contained in the paper feeding tray 50 as a stack thereof and ejected by a paper feeding roller 110 one by one. An ejected paper sheet P passes through a stop roller pair 49 and is conveyed to a gap between the photoconductor body 41 and the transfer device 48. The paper sheet P is conveyed to a gap between the photoconductor body 41 and the transfer device 48 so that a toner image on the photoconductor body 41 is transferred thereto. The paper sheet P with the transferred toner image is conveyed to the fixing device 10 and the toner image is fixed by the fixing device 10.

Furthermore, the image formation apparatus 1 is provided with a main electric power source device 9 and electrical supply to each member described above is conducted by an electric power from the main electric power source device 9. The main electric power source device 9 is supplied with an electric power from a commercial electric power source by inserting a plug 51 into a socket of the commercial electric power source.

The fixing device 10 in the present embodiment that is used in the aforementioned image formation apparatus is composed of a heating roller 14 and a pressurizing roller 15 as fixing members. A paper sheet P is conveyed to a gap between the heating roller 14 and the pressurizing roller 15 and the conveyed paper sheet P is heated and pressurized to fix a toner image on the paper sheet P. Heating means 2 that are heat generation bodies are contained in an interior of the heating roller. For the heating means 2, it is possible to use, for example, a halogen heater or a sheathed wire.

A metal such as an aluminum or an iron is used for a roller base body of the heating roller 14 as a rotational member, and thereby, it is possible to Provide durability or prevent deformation caused by heating. It is preferable to form a releasing layer for preventing adherence of a toner on a surface of the heating roller 14. Furthermore, a plurality of heating members are provided in an interior of the heating roller 14, and thereby, heating of the heating roller 14 is conducted.

The pressurizing roller 15 is such that an elastic layer such as a rubber is formed on an outer periphery of a cored bar and contacts the heating roller to form a nip part together with the heating roller 14. A paper sheet P on which an unfixed toner image has been formed passes through this nip part and is conveyed so that it is possible to fix the toner image on the paper sheet P due to heat and pressure.

Here, a roller member that has a foam layer may be used as the pressurizing roller 15 to form a nip part together with the heating roller 14. In this case, it is possible to elevate a temperature of the heating roller 14 for a short period of time because heat of the heating roller is difficult to transfer to the pressurizing roller 15 due to a heat insulation effect of a foam layer.

It is desirable for a roller base body of the heating roller 14 to be made of, for example, a metal such as an aluminum or an iron, from the viewpoint(s) of durability, deformation caused by pressurization, or the like. Furthermore, it is desirable to form a releasing layer for preventing adherence of a toner on a surface of the heating roller 14 and it is desirable to apply a blacking treatment to an inner surface of the heating roller 14 for absorbing heat from a halogen heater efficiently. For the heating roller 14 described herein, it is possible to provide a fixing belt or the like other than a heating roller.

Control means 100 are composed of, for example, a microcontroller that incorporates a central processing unit (CPU) or the like. As described below, the control means 100 controls a temperature sensed by temperature sensors 11-13, and a heating state of heating members 21-24 based on a paper sheet width (or conveyed paper sheet width) of a paper sheet P.

Next, an internal structure of the heating roller 14 in the present embodiment will be described with reference to FIG. 2. FIG. 2 is a case where printing is conducted at a central part of the fixing device 10. For example, a plurality of linearly configured heating members 21-24 as heating means are arranged in an interior of the heating roller 14. Respective heating members 21-24 are independently provided in an interior of the heating roller 14 in a direction orthogonal to a direction of conveyance of a paper sheet P, that is, along a direction of a length of the heating roller 14, so as to be generally parallel to a rotational axis of the heating roller 14. Furthermore, the heating members 21-24 are provided at positions at which the heating roller 14 is spatially divided at radial directions thereof.

The heating members 21-24 are such that heating driving (heating states) thereof is/are controlled by the control means 100 described above. In the present embodiment, halogen heaters for emitting infrared rays are used as the heating members 21-24 and light emission from each halogen heater is controlled by the control means 100. The control means 100 control a rate of lighting of each halogen heater.

Here, in a case where halogen heaters are used as the heating members 21-24, it is preferable to apply blacking treatment to an inner surface of the heating roller 14 so as to absorb heat from halogen heaters efficiently.

The heating members 21-24 that are halogen heaters have light emission parts as heat generation parts. Light emission parts are provided in a direction orthogonal to a direction of conveyance of a paper sheet P, that is, at positions at which a direction of paper sheet conveyance of the heating roller 14 is divided into a plural number, and positions so as not to overlap with a light emission part of another heating member.

In a center alignment method as illustrated in FIG. 2, light emission parts (heat generation parts) of each heating member is placed at positions symmetric with respect to a center line C. Furthermore, an auxiliary light emission part (auxiliary heat generation part) is provided at a position interposed between two light emission parts in the heating members 21-23. That is, in the heating member 21, light emission parts **2*a*1 are provided at two positions symmetric with respect to the center line C, and further, an auxiliary light emission part 2*a*2 is provided at a position interposed between the two light emission parts 2*a*1. In the heating member 22, light emission parts 2*b*1 are provided at two positions symmetric with respect to the center line C, and further, an auxiliary light emission part 2*b*2 is provided at a position interposed between the two light emission parts 2*b*1. In the heating member 23, light emission parts 2*c*1 are provided at two positions symmetric with respect to the center line C, and further, an auxiliary light emission part 2*c*2 is provided at a position interposed between the two light emission parts 2*c*1. In the heating member 24, a light emission part 2*d*** is provided at one position centered at the center line C.

Furthermore, the light emission parts **2*a*1 of the heating member 21 and the light emission parts 2*b*1 of the heating member 22 are such that a light emission part is divided at boundary lines S1. The light emission parts 2*b*1 of the heating member 22 and the light emission parts 2*c*1 of the heating member 23 are such that a light emission part is divided at boundary lines S2. The light emission parts 2*c*1 of the heating member 23 and the light emission part 2*d* of the heating member 24 are such that a light emission part is divided at boundary lines S3. These heating members 21-24** have light emission areas of a light emission part at different positions so as not to overlap in a direction of a paper sheet width.

As illustrated in FIG. 2, the auxiliary light emission part **2*a*2 of the heating member 21 is provided at a position interposed between the two light emission parts 2*a*1 and a portion thereof overlaps with the light emission part 2*d*. Here, non-light-emission parts 2*a*3 are provided outside of the light emission parts 2*a*1 (at sides of both ends of the heating roller 14). In the heating members 22 and 23, the auxiliary light emission parts 2*b*2 and 2*c*2 are also provided similarly at positions to overlap with the light emission part 2*d*, and non-light-emission parts 2*b*3 and 2*c*3 are provided outside of the light emission parts 2*b*1 and 2*c*1. Here, a potion other than the light emission part 2*d* of the heating member 24 is a non-light-emission part. That is, the heating member 24 functions as a first heating member and the heating members 21-23 function as a second heating member. Therefore, the light emission part 2*d* functions as a first heat generation part and the light emission parts 2*a*1, 2*b*1, and 2*c*1** function as a second heat generation part. Furthermore, a plurality of second heating members are provided in the present embodiment.

In the present embodiment, an amount of heat generation of the auxiliary light emission parts **2*a*2, 2*b*2, and 2*c*2 is approximately 35-40% of that of the light emission parts (main light emission parts) 2*a*1, 2*b*1, and 2*c*1. That is, an amount of heat generation of the auxiliary light emission parts 2*a*2, 2*b*2, and 2*c*2 is less than that of the light emission parts 2*a*1, 2*b*1, and 2*c*1**. Here, an amount of heat generation of the auxiliary light emission parts to that of the main light emission parts is not limited to that described above, and the auxiliary light emission parts may be used within a range of, for example, approximately 10-80%.

Furthermore, temperature sensors 11, 12, and 13 for sensing a temperature of the heating roller 14 are arranged on a surface of the roller. That is, an outer surface temperature of a rotational member is sensed. The temperature sensor 11, the temperature sensor 12, and the temperature sensor 13 are placed at positions corresponding to the light emission part **2*a*1 at one side (left side of the figure), the light emission part 2b1 at one side (left side of the figure), and the light emission part 2d, respectively. Furthermore, no temperature sensor is placed for the two light emission parts 2c1 or the light emission part 2a1 or 2b1** placed at a position at a right side of the center line C. For a temperature sensor, for example, a contact-type thermistor or a non-contact-type temperature sensor such as a thermopile is used. It is possible for each light emission part to set a rate of lighting independently and be energized so that a control is conducted to generate an arbitrary amount of heat.

Thus, light emission parts placed at mutually different positions are used to address an excessive temperature elevation caused at a non-paper-sheet-conveyance part of the heating roller 14 or various paper sheet widths of paper sheets P with suppression of wasteful energy. Furthermore, it is possible to reduce the number of temperature sensors for monitoring heat generation of light emission parts and energizing and controlling the light emission parts so as to be less than the number of division of the light emission parts and thereby attain cost reduction.

Each light emission part is configured to have light emission parts that do not overlap with one another as provided in FIG. 2 and switched between lighting and non-lighting depending on a paper sheet width of a paper sheet to be conveyed. For example, in a case of a paper sheet width less than or equal to L1, only the heating member 24 is energized. The heating member is commonly energized for all of paper sheet widths so that the light emission part is lighted commonly. That is, the heating member 24 is used for sheet-shaped recording media with all of paper sheet widths. A control is conducted so that the heating members 23 and 24 are energized for a paper sheet width greater than L1 and less than or equal to L2, the heating members 22-24 are energized for one that is greater than L2 and less than or equal to L3, or the heating members 21-24 are energized for a case that is greater than L3.

In FIG. 2, the light emission parts 2a1, 2b1, and 2c1 are provided with respective corresponding temperature sensors. However, a configuration is provided in such a manner that a corresponding temperature sensor is not separately placed for the light emission parts 2c1, and sensing temperatures and controlling of the light emission parts 2c1 and 2d are conducted by one temperature sensor 13.

In a case of a center alignment method as illustrated in FIG. 2, a paper sheet is conveyed at a time of a printing operation on a condition that center alignment is conducted with respect to a direction perpendicular to a direction of conveyance in such a manner that a center in a direction of a paper sheet width always coincides with a machine center. That is, conveyance is conducted in such a mariner that a center in a direction of a paper sheet width is provided on the center line C. If a paper sheet width is a width that is slightly greater than L1, heat is hardly removed by a paper sheet from light emission areas of the light emission parts 2c1 whereas heat is removed from a portion corresponding to a light emission area of the light emission part 2d on the heating roller 14. For the temperature sensor 13 as a sensor for controlling the light emission parts 2c1 and 2d, a position of placement thereof is selected on a light emission area of the light emission part 2d to be provided more closely to a center.

The temperature sensor 13 is to conduct sensing of both temperatures that are a temperature of heating by the light emission part 2d of the heating member 24 and a temperature of heating by the light emission parts 2c1 and the auxiliary light emission part 2c2 of the adjacent heating member 23, and is a common temperature sensor corresponding to a plurality of light emission parts (heat generation parts). That is, it is arranged at a position corresponding to the light emission part 2d and senses a temperature of the heating member 23 with the light emission parts 2c1 arranged at positions adjacent to the heating member 24 and the light emission part 2d.

Next, a temperature control will be described. A temperature sensed by the temperature sensor 13 that is a common temperature sensor is output to the control means 100, and thereby, the control means 100 control light emission of the light emission part 2d of the heating member 24 and light emission of the light emission parts 2c1 and the auxiliary light emission part 2c2 of the heating member 23.

A control by the control means 100 is such that a correction value for homogenizing a surface temperature of the heating roller 14 is set between the two heating members 23 and 24, and the light emission parts 2d and 2c1 and the auxiliary light emission part 2c2 are controlled based on this correction value. That is, the control means 100 conducts a control of lighting of the light emission parts 2c1 with reference to a temperature sensed by the temperature sensor 13, because a temperature sensor for directly sensing a temperature due to heating of the light emission parts 2c1 is not present.

FIG. 3 illustrates a state of a control of lighting in a case where a paper sheet with a paper sheet width greater than L1 and less than or equal to L2 is conveyed. In this case, the heating members 23 and 24 are energized. In FIG. 3, Dc indicates a rate of lighting of the heating member 23 and Dd indicates a rate of lighting of the heating member 24, while Ts indicates a temperature on a surface of the heating roller 14 that is sensed by the temperature sensor 13. The illustrated state is such that an printing operation is conducted between times t1 to t2 and both rates of lighting Dc and Dd are higher than rates of lighting during waiting so that strong heating is provided in order to address a drop in a temperature on the roller that is caused by paper sheet conveyance. At this time, the rate of lighting Dd of the heating member 24 is calculated based on a value of the temperature Ts. For a calculation method, a PID control is used in such a manner that a control is conducted to set a light emission area of the heating member 24 near a target temperature.

On the other hand, the rate of lighting Dc is calculated in accordance with a calculation formula of Dc=Dd*Dh1 (wherein * indicates multiplication) wherein Dh1 is a value of correction of a rate of lighting. Similarly to the heating member 24, a preliminarily tuned value is used for Dh1 by taking preliminarily determined outputs of two light emission parts and an auxiliary light emission part into consideration so that a roller surface temperature with respect to a light emission area of the heating member 12 is also homogenized near a target temperature. A configuration capable of inputting a value of Dh1 variably in a range of, for example, 0-2 is provided so that it is possible to create an ideal temperature distribution even when a combination of light emission parts (heaters) to be used is changed. That is, in a case where the heating members 23 and 24 that have light emission parts whose temperatures are sensed by a common temperature sensor are used simultaneously, a ratio of rates of lighting of such heating members 23 and 24 (the light emission parts 2c1 and the auxiliary light emission part 2c2, and the light emission part 2d) is controlled in such a manner that a temperature of a surface of the heating roller 14 is uniform which corresponds to at least a range of a paper sheet width greater than L1 and less than or equal to L2.

FIG. 4 illustrates heat distributions of respective heating members. In FIG. 4, a solid line, a dotted line, a dashed one-dotted line, and a dashed two-dotted line indicate the heating member 24, the heating member 23, the heating member 22, and the heating member 21, respectively. Then, a transverse axis indicates a direction of a length of the heating roller 14 and a longitudinal axis indicates a temperature. As illustrates in FIG. 2, the light emission parts 2*c*1 of the heating member 23 are adjacent to the light emission part 2*d* of the heating member 24, and the auxiliary light emission part 2*c*2 of the heating member 24 is arranged to overlap with the light emission part 2*d* of the heating member 24. For example, in a case of conveyance of a paper sheet with a paper sheet width greater than L1 and less than or equal to L2, the light emission parts 2*c*1 and 2*d* and the auxiliary light emission part 2*c*2 are lighted. Sensing is conducted by the temperature sensor 13 arranged at a position of the light emission part 2*d* and a control of energizing of the heating members 23 and 24 is conducted at rates of lighting of the heating members 23 and 24 that are preliminarily tuned to provide a range of paper sheet conveyance less than or equal to L2 with a uniform temperature, so that it is possible for one temperature sensor to control temperatures of two heating members. Furthermore, because the non-light emission parts 2*c*3 are provided in a range outside L2, paper sheet conveyance outside a width of L2 is conducted without excessively elevating the temperature.

In a case where a width of a paper sheet is greater than L2, the heating members 21 and 22 are energized in addition to the two heating members 23 and 24 controlled by one temperature sensor 13. Light emission parts 2*a*-2*d* provided for the respective heating members act to elevate temperatures of areas other than corresponding ones due to heat conductance on the heating roller 14.

For example, in a case where a paper sheet width is greater than L2 and less than or equal to L3, the heating members 22-24 are energized and heat conducts to areas corresponding to the light emission parts 2*c*1 due to an effect of heat generation of the light emission parts 2*b*1. In such a case, temperatures of the heating roller 14 which correspond to the light emission parts 2*c*1 having no temperature sensor for direct monitoring thereof may be higher than a predetermined one. Alternatively, if suitable tuning of Dh1 for this case is conducted, a disadvantage may be caused in such a manner that a temperature is contrary insufficient to cause unfavorable fixing in a mode for lighting only the light emission parts 2*c*1 and 2*d* and the auxiliary light emission part 2*c*2. Then, in a case where the light emission parts 2*b*1, 2*c*1, and 2*d* and the auxiliary light emission parts 2*b*2 and 2*c*2 are lighted, Dh2 different from Dh1 is used as a value of correction of a rate of lighting and Dc is obtained in accordance with a formula of Dc=Dd*Dh2. Similarly, in a case where the light emission parts 2*a*1, 2*b*1, 2*c*1, and 2*d* and the auxiliary light emission parts 2*a*2, 2*b*2, and 2*c*2 are lighted, a value of correction of a rate of lighting Dh3 different from any of Dh1 and Dh2 is prepared and Dc is obtained in accordance with Dc=Dd*Dh3. Thereby, even when the number of heating member(s) to be lighted is changed, it is possible to attain homogenization of a temperature distribution in a longitudinal direction of the heating roller 14. That is, a ratio of rates of lighting of the heating member 24 that is a first heating member and the heating member 23 that has the light emission parts 2*c*1 adjacent to the light emission part 2*d* of the heating member 24, among the heating members 21-23 that are second heating members, is changed depending on the number of heating member(s) to be used.

Meanwhile, because the light emission part 21*d* is lighted for any paper sheet width, the frequency of lighting thereof is more than those of the other light emission parts 2*a*1, 2*b*1, and 2*c*1 and a load of lighting thereof is high. Hence, in the present embodiment, the auxiliary light emission parts 2*a*2, 2*b*2, and 2*c*2 are provided so as to overlap with the light emission part 2*d* as illustrated in FIG. 2. Thus, it is possible to reduce a load of lighting of the light emission part 2*d* when the heating members having these auxiliary light emission parts 2*a*2, 2*b*2, and 2*c*2 are operated (or when a width of a paper sheet to be conveyed is such that the light emission parts 2*a*1, 2*b*1, and 2*c*1 are lighted). That is, it is possible to reduce a load of the light emission part 2*d* as the number of heating member(s) to be operated is increased. Therefore, the rates of correction of lighting Dh1, Dh2, and Dh3 are determined by also taking a state(s) of an auxiliary light emission part(s) in respective cases into consideration.

According to the present embodiment, the heating members 21-24 are provided at positions at which a light emission part of another heating member is not overlapped therewith in a direction of a paper sheet width that is orthogonal to a direction of conveyance of a paper sheet P. Therefore, it is possible to address a problem of excessive temperature elevation caused on a portion of the heating roller 14 through which a paper sheet P is not conveyed or various paper sheet widths of paper sheets P with suppression of wasteful energy. Furthermore, it is possible to reduce a load applied to the heating member 24 and attain a long life thereof, because the auxiliary light emission parts 2*a*2, 2*b*2, and 2*c*2 of the heating members 21-23 overlap with the light emission part 2*d* of the heating member 24.

Furthermore, the light emission parts 2*c*1 of the heating member 23 whose temperature is not directly monitored by a temperature sensor is subjected to an influence of the heating member 22 having the light emission parts 2*b*1 outside thereof as it is lighted, and its temperature is elevated. This elevation is also taken into consideration for a value of correction of a rate of lighting preliminarily, so that it is possible to attain homogenization of a temperature distribution of the heating roller 14 even in a mode for lighting another heating member. Furthermore, it is possible to reduce the number of temperature sensors to be used for temperature sensing, and thereby attain cost reduction.

Furthermore, for two light emission parts (heaters) in which relationships of outputs of light emission parts are known preliminarily, a value of correction of a rate of lighting is prepared in which a difference of outputs thereof is taken into consideration. Thus, as a tendency of temperature elevation of a light emission part to which a correction control is applied is comparable with a tendency of temperature elevation of a light emission part as a reference, it is possible to provide an operation for uniformly heating the heating roller 14 even in a configuration having no separate temperature sensor. As a temperature distribution on the heating roller 14 is uniform, it is possible to provide a uniform quality of an output such as a print out. Furthermore, as a value of lighting correction is variable, it is possible to conduct the above-mentioned addressing instantaneously even when a heater configuration is changed.

Furthermore, it is possible to prevent excessive temperature elevation, because the heating members 21-24 are provided with non-light-emission parts.

Second Embodiment

Figure 5:
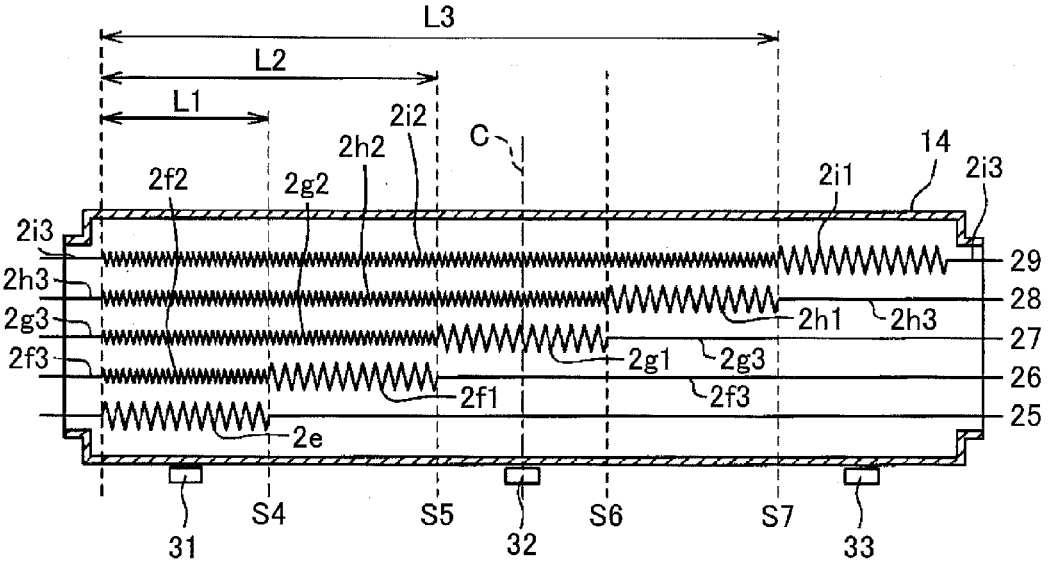
FIG. 5 is a schematic and cross-sectional diagram that illustrates positions of heat generation parts in a fixing device according to a second embodiment of the present invention.

Next, a fixing device 10 according to a second embodiment of the present invention will be described with reference to FIG. 5. Here, a part identical to that of the aforementioned first embodiment is provided with an identical reference numeral and a description(s) thereof will be omitted. FIG. 5 is a schematic cross-sectional diagram that illustrates positions of heat generation parts in such a fixing device according to the second embodiment of the present invention.

Whereas an example of the image formation apparatus 1 that adopts a center alignment method has been described in the first embodiment, the present embodiment is an example of a side alignment method. A side alignment method is such that, at a time of a printing operation, a paper sheet P is conveyed on a side alignment condition in such a manner that one side of the paper sheet is always aligned with one side of a machine in a direction perpendicular to a direction of conveyance. An example of an internal structure of a heating roller 14 in a case of a side alignment method will be described with reference to FIG. 5.

In FIG. 5, for example, a plurality of heating members 25-29 are arranged in an interior of the heating roller 14. Each of the heating members 25-29 is independently provided in an interior of the heating roller 14 so as to be generally parallel to a rotational axis of the heating roller in a direction orthogonal to a direction of conveyance of a paper sheet P, that is, a direction of a length of the heating roller 14. Furthermore, the heating members 25-29 are provided at positions at which the heating roller 14 is spatially divided in radial directions.

For example, the heating members 25-29 that use halogen heaters have light emission parts as heat generation parts. Heat generation parts are provided at positions at which a direction orthogonal to a direction of conveyance of a paper sheet P, that is, a paper sheet conveyance direction of the heating roller 14, is divided into a plural number and at which a light emission part of another heating member is not overlapped therewith.

In FIG. 5, light emission parts 2*e*, 2*f*1, 2*g*1, 2*h*1, and 2*i*1 are arranged in an interior of the heating roller 14. The light emission part 2*e* and the light emission part 2*f*1 are such that the light emission parts are divided at a boundary line S4. The light emission part 2*f*1 and the light emission part 2*g*1 are such that the light emission parts are divided at a boundary line S5. The light emission part 2*g*1 and the light emission part 2*h*1 are such that the light emission parts are divided at a boundary line S6. The light emission part 2*h*1 and the light emission part 2*i*1 are such that the light emission parts are divided at a boundary line S7. The light emission parts 2*e*, 2*f*1, 2*g*1, 2*h*1, and 2*i*1 have light emission areas at positions different from one another in a direction of width of a paper sheet (a width of paper sheet conveyance).

Furthermore, the heating members 26-29 are provided with auxiliary light emission parts 2*f*2, 2*g*2, 2*h*2, and 2*i*2. The auxiliary light emission parts 2*f*2, 2*g*2, 2*h*2, and 2*i*2 are arranged at left sides of respective corresponding light emission parts (in a case of FIG. 5), that is, provided at positions to overlap with the light emission part 2*e* that is used for paper sheets P with all of widths of paper sheet conveyance. Here, non-light-emission parts 2*f*3, 2*g*3, 2*h*3, and 2*i*3 are provided at right sides of the light emission parts 2*f*1, 2*g*1, 2*h*1, and 2*i*1 of the heating members 26-29 and at left sides of the auxiliary light emission parts 2*f*2, 2*g*2, 2*h*2, and 2*i*2 thereof. Furthermore, the heating member 25 is such that a portion other than the light emission part 2*e* is a non-light-emission part.

Furthermore, temperature sensors 31, 32, and 33 for sensing a temperature of the heating roller 14 are arranged on a surface of the roller, wherein the temperature sensor 31, the temperature sensor 32, and the temperature sensor 33 are placed to correspond to the light emission part 2*e*, the light emission part 2*g*1, and the light emission part 2*i*1. For a temperature sensor, for example, a contact-type thermistor or a non-contact-type temperature sensor such as a thermopile is used. Each light emission part is energized by independently setting a rate of lighting thereof, and thereby, it is possible to be controlled so as to generate an arbitrary amount of heat generation. Here, a non-contact-type thermistor may be used instead of a contact-type thermistor.

Respective heating members are configured to have light emission parts that do not overlap with one another as illustrated in FIG. 5 and are switched between lighting and non-lighting depending on a width of a paper sheet to be conveyed. For example, only the light emission part 2*e* is lighted in a case of a paper sheet width less than or equal to L1 and the light emission part 2*e* is always lighted for all of paper sheet widths. The light emission parts 2*e* and 2*f*1 and the auxiliary light emission part 2*f*2 are lighted in a case of a paper sheet width greater than L1 and less than or equal to L2. The light emission parts 2*e*, 2*f*1, 2*g*1, and 2*h*1 and the auxiliary light emission parts 2*f*2, 2*g*2, and 2*h*2 are lighted in a case greater than L2 and less than or equal to L3. A control is conducted to light the light emission parts 2*e*, 2*f*, 2*g*, 2*h*, and 2*i* and the auxiliary light emission parts 2*f*2, 2*g*2, 2*h*2, and 2*i*2 in a case greater than L3.

In FIG. 5, the light emission parts 2*e*, 2*g*1, and 2*i*1 are provided with respectively corresponding temperature sensors. However, the light emission parts 2*f*1 and 2*h*1 are placed with no corresponding temperature sensor and configured to conduct sensing of temperatures thereof and a control for elevation of the temperatures by temperature sensors corresponding to adjacent light emission parts.

In a case of a side alignment method, a paper sheet P is conveyed in a side alignment condition (at a left side in a case of FIG. 2) during a printing operation, in such a manner that one side of the paper sheet is always aligned with one side of a machine in a direction orthogonal to a direction of conveyance (in a direction of a paper sheet width) as described above. If a width of a paper sheet is a width that is slightly greater than L1, heat is removed from a portion of the heating roller that corresponds to a light emission area of the light emission part 2*e* by the paper sheet but heat is hardly removed for a light emission area of the light emission part 2*f*1. The temperature sensor 31 as a sensor for controlling the light emission parts 2*e* and 2*f*1 is such that a position of placement thereof is selected to be on a light emission area of the light emission part 2*e* that is always lighted for conveyance of a paper sheet and is nearest one side.

The temperature sensor 31 conducts temperature sensing for both a heating temperature of the light emission part 2*e* of the heating member 25 and a heating temperature of the light emission part 2*f*1 and the auxiliary light emission part 2*f*2 of the heating member 26 adjacent thereto, and is a common temperature sensor. Furthermore, the temperature sensor 32 conducts temperature sensing for both a heating temperature of the light emission part 2*g*1 of the heating member 25 and a heating temperature of the light emission part 2*f*1 and the auxiliary light emission part 2*f*2 of the heating member 28 adjacent thereto, and this temperature sensor is also a common temperature sensor.

That is, a common temperature sensor is not limited to one that is arranged at a position corresponding to a first heat generation part and senses of temperatures of a first heating member and a second heating member in which a second heat generation part is arranged at a position adjacent to a first heat generation part, as described for the first embodiment. That is, a configuration may be provided to be arranged at a position corresponding to a second heat generation part and to sense temperatures of a second heating member having the second heat generation part and a first heating member in which a first heat generation part is arranged at a position adjacent to the second heat generation part.

It is sufficient to conduct a temperature control in a manner identical to that of the first embodiment. That is, a value of correction of a rate of lighting to provide a uniform surface temperature of the heating roller 14 is set between the two heating members 25 and 26 and a control is conducted based on this value of correction of a rate of lighting in such a manner that amounts of heat generation of the heating members 25 and 26 are equal. Furthermore, a value of correction of a rate of lighting is also set between the heating members 27 and 28 and a control is conducted based on this value of correction of a rate of lighting in such a manner that amounts of heat generation of the heating members 27 and 28 are equal. However, for the heating members 27 and 28, it is necessary to determine a value of correction of a rate of lighting in such a manner that a surface temperature of the heating roller 14 is homogenized while heat generation of the heating members 25 and 26 is also taken into consideration.

Here, although a left side of a paper sheet P is aligned with a left side of the heating roller 14 in FIG. 5, it goes without saying that alignment with a right side may be conducted. In such a case, auxiliary light emission parts are provided at right sides of the light emission parts 2*e*, 2*f*1, 2*g*1, and 2*h*1 of the heating members 25-28, because the light emission part 2*i*1 of the heating member 29 is always lighted for all of paper sheet widths.

According to the present embodiment, the heating members 25-29 are provided at positions so as not to overlap with a light emission part of another heating member in a direction of a width of a paper sheet P that is orthogonal to a direction of conveyance of the paper sheet, even in a case of an image formation apparatus 1 with a side alignment. Therefore, it is possible to address generation of excessive temperature elevation at a portion of the heating roller 14 through which a paper sheet P is not conveyed, various paper sheet widths of paper sheets P with suppression of wasteful energy. Furthermore, it is possible to reduce a load applied to the heating member 25 and attain a long-life thereof, because the auxiliary light emission parts 2*f*2, 2*g*2, 2*h*2, and 2*i*2 of the heating members 26-29 are provided so as to overlap with the light emission part 2*e* of the heating member 25. Moreover, it is possible to reduce the number of temperature sensors so as to attain cost reduction, because temperatures of the heating member 25 and the heating member 26 are sensed by a common temperature sensor to conduct a control of an amount of heat generation.

Here, although a roller method wherein a rotation member for conveying a paper sheet P and fixing a toner image thereon is composed of the heating roller 14 and the pressurizing roller 15 has been illustrated in the embodiment described above, it is also possible to apply an embodiment of the present invention to a belt method similarly. although illustration of a belt method is omitted, for example, an endless fixing belt extends on a heating roller and another roller (that may be a plurality thereof) and the fixing belt contacts a pressurizing roller, so that a paper sheet P is conveyed between the fixing belt and the pressurizing roller.

A heating roller in this belt method is provided with a plurality of heating members in the embodiment described above and heating thereof is controlled by control means, so that such heating is transmitted to a fixing belt to conduct heating of the fixing belt and a toner image P is fixed on a paper sheet P. Thereby, it is also possible to conduct efficient heating in a belt-type fixing device and it is unnecessary to conduct driving at a high rate of heating so that excessive temperature elevation is not caused for a fixing belt. Therefore, it is possible to prevent an issue such as deformation of a fixing belt that is caused by a temperature elevation thereof. Furthermore, it is possible to reduce the number of temperature sensors that are used for temperature sensing and thereby attain cost reduction.

Furthermore, although an example has been described in the embodiment above in such a manner that heat generation parts of the heating members 25-29 for heating roller 14 are composed of halogen heaters, no limitation thereto is provided and a nichrome wire heater, a sheathed heater, or the like may be used.

Furthermore, an auxiliary light emission part may be such that an amount of heat thereof is not uniform. For example, in a case of FIG. 2, an amount of heat may be decreased with a distance from the light emission part 2*d* that is always energized for all of paper sheet widths, or on the contrary, an amount of heat may be increased with a distance from the light emission part 2*d*.

Furthermore, although four (or five) heating members and three temperature sensors corresponding thereto are provided in the embodiment described above, an embodiment of the present invention is not limited thereto. For example, an increase or a decrease thereof may appropriately be conducted depending on a kind of a size of a paper sheet to be used.

Furthermore, the present invention is not limited to the embodiments described above. That is, it is possible for a person(s) skilled in the art to provide a modification and implementation thereof variously based on a conventionally publicly-known knowledge without departing from the spirit and scope of the present invention. As long as even configurations of a fixing device and an image formation apparatus according to an embodiment(s) of the present invention are provided, such a modification is, of course, included in the scope of the present invention.

APPENDIX

<An Illustrative Embodiment(s) of a Fixing Device and an Image Formation Apparatus>

At least one illustrative embodiment of the present invention may relate to at least one of a fixing device for fixing a toner image on a recording medium such as a recording paper sheet and an image formation apparatus provided with such a fixation device.

An object of at least one illustrative embodiment of the present invention may be to provide a fixing device with a configuration that is capable of solving a problem that occurs in a case where sheet-shaped recording media on various conditions are conveyed while keeping high productivity and is also capable of attaining a long life of a component thereof or a reduced cost simultaneously.

At least one illustrative embodiment of the present invention may be a fixing device for dealing with a plurality of feeding paper widths of sheet-shaped recording media in a direction orthogonal to a direction of conveyance thereof, wherein the fixing device is characterized by being provided with a rotational member for conveying, and elevating a temperature of, the sheet-shaped recording media on which unfixed toner images have been formed, to fix the toner images thereon, a temperature sensor for sensing an outer surface temperature of the rotational member, a first heating member that is used for the sheet-shaped recording media with all the feeding paper widths and configured to have a first heat generation part as a portion thereof and be shaped linearly, a second heating member that has a second heat generation part as a portion thereof and configured to have an auxiliary heat generation part adjacent to the second heat generation part further and be shaped linearly, and control means for controlling heating states of the first heating member and the second heating member based on the feeding paper widths of the sheet-shaped recording media, wherein the first heating member and the second heating member are provided inside the rotational member and parallel to a rotational axis of the rotational member, wherein the first heat generation part and the second heat generation part are provided not to overlap with each other in a direction of the feeding paper widths that is orthogonal to the direction of conveyance of the sheet-shaped recording media, wherein at least a portion of the auxiliary heat generation part is provided to overlap with the first heat generation part, wherein the temperature sensor is a common temperature sensor that is arranged at a position corresponding to the first heat generation part and senses temperatures of the first heating member and the second heating member in which the second heat generation part is arranged at a position adjacent to the first heat generation part, and wherein the control means control a ratio of rates of lighting of the first heating member and the second heating member whose temperatures are sensed by the common temperature sensor in such a manner that the surface temperature of the rotational member is uniform, in a case where the first heating member and the second heating member whose temperatures are sensed by the common temperature sensor are used simultaneously.

Illustrative Embodiment (1) is a fixing device for dealing with a plurality of feeding paper widths of sheet-shaped recording media in a direction orthogonal to a direction of conveyance thereof, wherein the fixing device is characterized by being provided with a rotational member for conveying, and elevating a temperature of, the sheet-shaped recording media on which unfixed toner images have been formed, to fix the toner images thereon, a temperature sensor for sensing an outer surface temperature of the rotational member, a first heating member that is used for the sheet-shaped recording media with all the feeding paper widths and configured to have a first heat generation part as a portion thereof and be shaped linearly, a second heating member that has a second heat generation part as a portion thereof and configured to have an auxiliary heat generation part adjacent to the second heat generation part further and be shaped linearly, and control means for controlling heating states of the first heating member and the second heating member based on the feeding paper widths of the sheet-shaped recording media, wherein the first heating member and the second heating member are provided inside the rotational member and parallel to a rotational axis of the rotational member, wherein the first heat generation part and the second heat generation part are provided not to overlap with each other in a direction of the feeding paper widths that is orthogonal to the direction of conveyance of the sheet-shaped recording media, wherein at least a portion of the auxiliary heat generation part is provided to overlap with the first heat generation part, wherein the temperature sensor is a common temperature sensor that is arranged at a position corresponding to the first heat generation part and senses temperatures of the first heating member and the second heating member in which the second heat generation part is arranged at a position adjacent to the first heat generation part, and wherein the control means control a ratio of rates of lighting of the first heating member and the second heating member whose temperatures are sensed by the common temperature sensor in such a manner that the surface temperature of the rotational member is uniform, in a case where the first heating member and the second heating member whose temperatures are sensed by the common temperature sensor are used simultaneously.

Illustrative Embodiment (2) is the fixing device as described in Illustrative Embodiment (1), which is characterized in that a plurality of the second heating members are provided therein and the control means change the ratio of rates of lighting of the first heating member and the second heating member whose temperatures are sensed by the common temperature sensor, depending on the number of the second heating members to be used, when the first heating member and the plurality of the second heating members are used.

Illustrative Embodiment (3) is an image formation apparatus that is characterized by being provided with the fixing device as described in Illustrative Embodiments (1) or (2).

According to at least one illustrative embodiment of the present invention, a first heating member and a second heating member are provided at a position in such a manner that a first heat generation part and a second heat generation part do not overlap with each other in a direction of a feeding paper width of a sheet-shaped recording medium which is orthogonal to a direction of conveyance thereof. Therefore, it may be possible to deal with a problem that excessive temperature elevation is caused at a portion of a rotational member on which a sheet-shaped recording medium does not pass, or various feeding paper widths in such a manner that wasteful energy is suppressed.

Although the illustrative embodiment(s) and specific example(s) of the present invention have been described with reference to the accompanying drawing(s), the present invention is not limited to any of the illustrative embodiment(s) and specific example(s), and the illustrative embodiment(s) and specific example(s) may be altered, modified, or combined without departing from the scope of the present invention.

The present application is based on and claims the benefit of priority to Japanese Patent Application No. 2013-132921 filed on Jun. 25, 2013, the entire content(s) of which is/are herein incorporated by reference.

What is claimed is:

1. A fixing device for fixing a toner image on a sheet-shaped recording medium, comprising:

a rotational member configured to convey and heat the sheet-shaped recording medium, the rotational member including a first heating member and a plurality of second heating members provided in parallel to a rotational axis of the rotational member in an interior thereof, the first heating member including only one heat generation part, the heat generation part being aligned with a center portion of the rotational member in a direction orthogonal to the rotational axis of the rotational member and on which a plurality of types of the sheet-shaped recording medium are commonly conveyed, the plurality of second heating members each including a plurality of heat generation parts and an auxiliary heat generation part abutting two of the plurality of heat generation parts, the one heat generation part of the first heating member and the plurality of heat generation parts of each of the plurality of second heating members being provided not to overlap in a direction orthogonal to a direction of conveyance of the sheet-shaped recording medium, the auxiliary heat generation part of each of the plurality of second heating members being provided to overlap with the one heat generation part of the first heating member in the direction orthogonal to the direction of conveyance of the sheet-shaped recording medium;

a common temperature sensor configured to sense a temperature of the first heating member and a temperature of the plurality of second heating members, the common temperature sensor being located at a position that overlaps with the one heat generation part of the first heating member in the direction orthogonal to the direction of conveyance of the sheet shaped recording medium; and a control part configured to control a ratio of a rate of lighting of the first heating member and a rate of lighting of the plurality of second heating members based on the temperature of the first heating member and the temperature of the plurality of second heating members in a case where the first heating member and the plurality of second heating members are lighted, wherein each of the auxiliary heat generation parts has a heating capacity less that of the one heat generation part and less than each of the plurality of heat generation parts of the plurality of second heating members, and wherein the auxiliary heat generation part is disposed between the heat generation parts in at least one of the plurality of second heating members.

2. The fixing device as described in claim 1, wherein the control part is configured to control the ratio of the rate of lighting of the first heating member and rates of lighting of the plurality of second heating members depending on the number of the plurality of second heating members in a case where the first heating member and the plurality of second heating members are lighted.

3. An image formation apparatus, comprising: the fixing device as claimed in claim 1.

4. The fixing device as described in claim 1, wherein the first heating member includes a non-heat generation part that overlaps the heat generation part of each of the plurality of second heating members in the direction orthogonal to the direction of conveyance of the sheet-shaped recording medium.

5. The fixing device as described in claim 4, wherein each of the plurality of second heating members includes a non-heat generation part that overlaps the non-heat generation part of the first heating member in the direction orthogonal to the direction of conveyance of the sheet-shaped recording medium.

6. The fixing device as described in claim 2, wherein a first of the plurality of second heating members includes a first auxiliary heater that overlaps the one heat generation part of the first heating member in the direction orthogonal to the direction of conveyance of the sheet-shaped recording medium and a second of the plurality of second heating members includes a second auxiliary heater that overlaps the one heat generation part of the first heating member and the first auxiliary heater of the first of the plurality of second heating members in the direction orthogonal to the direction of conveyance of the sheet-shaped recording medium.

7. The fixing device as described in claim 1, wherein the a center portion of the rotational member has a width that is the same as a minimum width among widths of the plurality of types of sheet-shaped recording media.

8. The fixing device as described in claim 1, wherein the common temperature sensor overlaps with the center portion of the rotational member.

* * * * *